US007784602B2

(12) United States Patent
Mueller

(10) Patent No.: US 7,784,602 B2
(45) Date of Patent: Aug. 31, 2010

(54) CONVEYING SYSTEM

(75) Inventor: Erwin Mueller, Duernten (CH)

(73) Assignee: Ferag AG, Hinwil (CH)

( * ) Notice: Subject to any disclaimer, the term of this patent is extended or adjusted under 35 U.S.C. 154(b) by 194 days.

(21) Appl. No.: 11/997,051

(22) PCT Filed: Jul. 10, 2006

(86) PCT No.: PCT/CH2006/000363

§ 371 (c)(1),
(2), (4) Date: Mar. 4, 2008

(87) PCT Pub. No.: WO2007/045105

PCT Pub. Date: Apr. 26, 2007

(65) Prior Publication Data

US 2008/0210521 A1 Sep. 4, 2008

(30) Foreign Application Priority Data

Jul. 29, 2005 (CH) ..... 1271/05

(51) Int. Cl.
*B65G 47/84* (2006.01)

(52) U.S. Cl. ..... 198/470.1; 198/475.1; 198/644

(58) Field of Classification Search ..... 198/470.1, 198/474.1, 475.1, 644, 686
See application file for complete search history.

(56) References Cited

U.S. PATENT DOCUMENTS 1,329,936 A 2/1920 Spiess
3,139,175 A * 6/1964 Wells ..... 198/686
4,398,629 A 8/1983 Williamson
5,007,624 A * 4/1991 Chandhoke ..... 270/58.2
5,380,000 A * 1/1995 Ohno ..... 198/803.9
6,062,372 A 5/2000 Cote et al.
6,213,461 B1 * 4/2001 Ratz et al. ..... 198/470.1
6,401,903 B1 * 6/2002 Berni ..... 198/370.1

FOREIGN PATENT DOCUMENTS

EP 0 819 635 A2 1/1998
GB 873921 8/1961

* cited by examiner

*Primary Examiner*—James R Bidwell
(74) *Attorney, Agent, or Firm*—Rankin, Hill & Clark LLP

(57) ABSTRACT

A conveying system to be used in the printing industry, especially in mailroom technology, includes a revolvingly driven conveying member that is provided with supporting elements that are fixed to a traction rope in a stationary and optionally torsion-proof manner. The conveying member can be provided with another rope that has the same length as the traction rope, revolves substantially parallel thereto, and is used as a guide rope or second traction rope. Grippers that are disposed laterally on the belt-shaped conveying member, which is formed by ropes and supporting elements, are arranged on the supporting elements in order to grab and hold individual printed products or groups of printed products. The conveying member is deflected onto different deflection planes via guiding devices while being twisted between such deflections such that the three-dimensional position of the supporting elements and the conveyed printed products can be modified. The guiding devices are equipped with revolving guiding members that are positioned so as to be in contact with the supporting elements.

23 Claims, 6 Drawing Sheets

2
1.3
4.1
4
4.2
6.1
6.2
VIII
VIII
1
3

3
1.3
40
6.2
4.1
6.1

CONVEYING SYSTEM

BACKGROUND OF THE INVENTION

The invention lies in the field of conveyor technology, and relates to a conveyor system according to the preamble of the independent patent claim. The conveyor system serves for conveying printed products, in particular newspapers, magazines, brochures or parts thereof.

Known conveyor systems for the application in field of printer's shops, in particular with regard to mailroom technology, with whose help printed products are to be conveyed in a held manner, are usually chain transporters, thus have a revolvingly driven conveyor member in the form of a chain, on which gripper elements are arranged at regular distances, with which the printed products are gripped and conveyed. A suitable design of the chain, in particular with chain links which are capable of rolling and roll along in a suitable channel, permit the realization of revolving paths or conveyor paths extending in three dimensions with such chain transporters. It is also simply possible with such chain transporters, to convey the printed products conveyed in a held manner, or the gripper elements used for this, in a very accurate sequence. High demands with regard to accuracy are particularly placed on the gripping and the releasing of the printed products by way of the gripper elements and for the processing of the printed products during the conveying. The disadvantages of the chain transporters, as the case may be, lie in the fact that they are relatively expensive, and the distances of the gripper elements on a predefined chain may only be changed in a very restricted manner.

In other technical fields, it is counted as belonging to the state of the art, to use conveyor systems based on cables for the conveyor purposes, not only for the relatively large scale transport of humans (cable cars, ski lifts), but also for the small scale transport of articles. In such a conveyor system, carrier elements (chairs, gondolas etc) or catches, which are to be loaded with the people or goods to be conveyed, or to which the persons or goods are to be coupled, are fastened on a pull cable. The cable thereby first and foremost serves as a pull means, but may also simultaneously carry the carrier elements and determine their revolving path. If the cable merely serves as a pull means, then the carrier elements usually comprise runner rollers which roll along on suitable carrier rails determining the revolving path of the carrier elements. Usually, the revolving path of the cable or of the carrier elements runs in a plane, but systems with three-dimensional revolving paths are also known. The carrier elements usually have articulated connections between the cable and the loading region, in a manner such that the loading region always hangs freely from the cable, thus is equally directed relative to gravity, so that the carrier elements always have the same spatial position at regions of the peripheral path, which are directed differently with regard to gravity.

One example of a goods conveyor system of the above mentioned type is described in the publication GB-873921.

Applications of conveyor systems functioning with a pull cable and carrier elements fastened thereon, in the field of printer's shops and in particular with regard to mailroom technology are not known. The corresponding tasks, as briefly described above, are usually assumed by chain transporters with grippers. A reason for this is probably the high precision which has likewise been discussed above, and which is necessary with regard to the spatial attitude and position of the grippers or the printed products which are conveyed held by the grippers. The man skilled in the art assumes that such accuracy is very simple to accomplish with a chain transporter.

BRIEF SUMMARY OF THE INVENTION

It is therefore the object of the invention, to provide a conveyor system which may be applied for the demands in the field of printer's shops and in particular with regard to mailroom technology, in a very flexible manner, wherein this conveyor system may not only attain the required accuracy in the same manner as the known chain transporters, but may master the required flexibility better than the chain conveyor. The conveyor system according to the invention should therefore not only be suitable to be set up for the most different of conveyor tasks, but it should also be suitable to accomplish such different conveyor tasks at different locations of a single revolving path in an essentially simultaneous manner. Despite this, the conveyor system according to the invention should be simple in manufacture and in operation.

This object is achieved by the conveyor system as is defined in the patent claims.

The conveyor system according to the invention, as with the initially mentioned conveyor systems known from other fields of technology, comprises a revolvingly driven conveyor member, which consists essentially of a pull cable and a plurality of carrier elements. The carrier elements are equipped for a positionally fixed and, if required, a rotationally secured fastening on the pull cable, and they each carry a gripper at their one end. The grippers are suitable for carrying individual printed products or of larger or smaller groups of printed products. The ends of the carrier elements equipped with the grippers, given an untwisted pull cable, project away from the pull cable in the same direction, which means that the carrier elements are aligned to one another and the grippers are arranged in a row essentially parallel to the pull cable. The carrier elements are not only pulled, but also carried by the pull cable. The pull cable is slightly tensioned for this.

The conveyor system according to the invention preferably comprises a further cable additionally to the pull cable, and this further cable is essentially equally long as the pull cable and revolves essentially parallel to this, and may serve as a guide cable or as a further pull cable, and in any case, guides and holds the carrier elements in their position aligned to one another. If the further cable is designed as a guide cable, the carrier elements are only loosely fastened thereto, and are only held in the position aligned to one another by the guide cable. If the further cable is to serve as a second pull cable, the carrier elements are fastened thereon as on the first pull cable. In both cases, the two cables together with the carrier elements form a stable, belt-like revolving conveyor member, on whose one narrow side the grippers are arranged in a row. Of course, the conveyor system according to the invention may also comprise more than two cables, of which at least one serves as a pull cable, which means that the carrier elements are fastened or may be fastened on at least one of the cables in a positionally fixed manner.

The conveyor system according to the invention may also comprise only the pull cable and no further cable. In this case, the carrier elements are not only fastened or fastenable on the pull cable in a positionally fixed manner, but also in a rotationally secured manner.

The conveyor system according to the invention further comprises at least one drive, and guide means which are arranged along the revolving path and by way of which the revolving path of the conveyor member is generally defined, which particularly also means the revolving path of the grippers and thus also the course of the conveyor path along which printed products held by the grippers are conveyed. The grippers are closed and opened for gripping and releasing printed products.

The revolving path of the conveyor member in the conveyor system according to the invention is in particular a three-dimensional formation, wherein the guide means deflect the conveyor member in different planes, and in particular in planes which are not parallel to one another. The conveyor member is twisted between such deflections, in a manner such that the carrier elements relative to the deflection plane are always directed equally, in particular perpendicularly to the deflection plane, so that guide means functioning according to the same principle may be applied for the deflections independently of the position of the deflection planes, said guide means preferably engaging neither on the pull cable nor on the further cables, but on the carrier elements. Further guide means functioning according to the same principle may be applied, in order not to deflect the conveyor member, but to create twists on straight-lined regions of its revolving path, or by way of such twists, to bring the carrier elements and in particular the grippers arranged thereon or the printed products held by these, into a predefined position, e.g. for the gripping, releasing or the processing of printed products held by the grippers. If the conveyor member only comprises the pull cable and no further cable and is significantly less stable than a conveyor member with one or more cables by way of this, it may then be advantageous to also apply guide means functioning according to the same principle, also on straight-lined revolving path regions without any twisting, thus merely for stabilizing the conveyor member.

Selected guide means may also assume a drive function additionally to their guiding function.

Evidently, the guide means of the system according to the invention play a very central role. They are not only applied where a change in direction (deflection) in the revolving path is to be realized, but also where the conveyor member is to be twisted without a change in direction or is only to be stabilized. As already mentioned, preferably it is always the same type of guide means which is used for the different guide functions, wherein this guide means type is to be as independent as possible of the distance of the carrier elements on the pull cable, so that it may be used in an unchanged manner in conveyor systems or regions thereof, which are provided for the most varied of conveyor functions. These guide means, as already mentioned, preferably engage not on the pull cable or on further cables, but on the carrier elements, and specifically offset with respect to the pull cable and the further cables, and on the one side or on two opposite sides of the carrier elements, depending on the guide function. The parts of the guide means contacting the carrier elements are revolving guide members, in particular revolving guide belts or guide chords. Of course, the conveyor system according to the invention may also comprise other types of guide means, additionally to the mentioned preferred type of guide means, or of drives combined with guide means.

The connection between the carrier element and the pull cable may be rigid, wherein the carrier elements are then preferably fastened at regular distances to one another along the pull cable. The connection between the carrier element and the pull cable may however also be releasable, in a manner such that the pull cable continues to act as a guide cable when the connection is released, or in a manner such that the carrier element may be completely decoupled from the pull cable. If the pull cable acts as a guide cable when the connection of the carrier elements is released, then for example in this condition, the distances between the carrier elements may be varied during the conveyor operation, and the carrier elements may also stand still relative to the pull cable and for example be buffered.

The carrier elements may be equipped with the most varied of grippers for gripping, holding and releasing printed products. Essentially, all types of known such grippers may be applied, as well as essentially all control means which are known for the opening and closure of such grippers. The grippers grasp the printed products in the manner known per se, in the region of an edge. This edge may be aligned parallel to the conveyor direction, wherein the distances of the gripper is of such a size, that each gripper grips a printed product, and these are conveyed overlapping one another and one after the other. It is however also possible, with grippers or carrier elements arranged suitably closer to one another, to provide an imbricate flow, wherein each gripper grips a plurality of products overlapping one another, and each product is held by a plurality of grippers. The product edges gripped or to be gripped by the grippers may also be aligned transversely to the conveyor direction, so that the printed products are aligned in a compacted flow one after the other and essentially aligned on one another. Of course, it is possible to arrange the grippers on the carrier elements in a tiltable, pivotable or rotatable manner, wherein control means are provided at predefined locations of the revolving path, by way of which certain tilt-positions, pivot positions or rotation positions may be set and/or maintained at predefined locations of the revolving path.

BRIEF DESCRIPTION OF THE DRAWINGS

Exemplary, preferred embodiments of the conveyor system according to the invention are described in detail by way of the following figures. With this, they are shown in.

DETAILED DESCRIPTION OF THE INVENTION

Figures 1, 2:
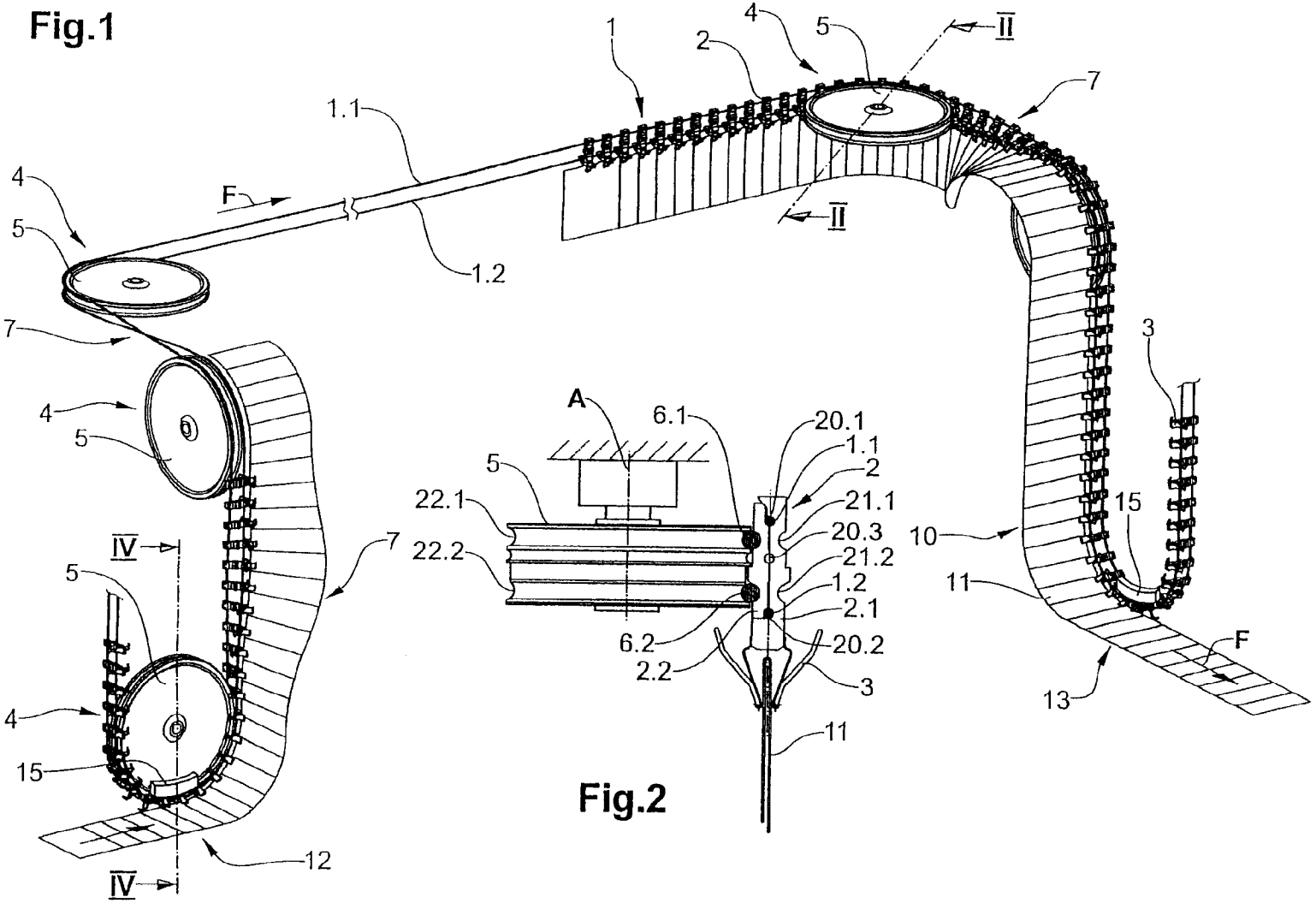
FIG. 1 is a perspective view of one exemplary embodiment of the conveyor system according to the invention, said embodiment comprising deflection wheels deflecting the conveyor member in different planes.
FIG. 2 is a cross-sectional elevation view of a deflection by way of deflection wheel of the conveyor system according to FIG. 1 (section parallel to the axis of the deflection wheel, section line II-II in FIG. 1)

FIG. 1 shows a very schematic representation of a first, preferred embodiment of the conveyor system according to the invention, of which only one part which is of relevance to the conveying is represented. The conveyor system comprises two equally long, closed cables 1.1 and 1.2 which are in each case closed into an endless loop and which are driven in a revolving manner at the same speeds essentially parallel to one another, and together with the carrier elements 2, form an endlessly revolving, belt-like conveyer member 1, on which the grippers 2 are arranged laterally in a row. At least one of the cables, preferably the cable 1.1 further distanced from the grippers, serves as a pull cable which means that the carrier elements are fastened thereon in a positionally fixed manner.

The carrier elements 2 which are not all shown in FIG. 1, are fastened on the pull cable 1.1 at regular distances, and are in each case equipped with a gripper 3 arranged laterally of the belt-like conveyor member. The revolving path of the conveyor member 1 is defined by guide means 4, which in the shown case are designed as freely rotating deflection wheels 5, wherein a plurality of guide members 6.1 and 6.2 revolving with the rotating deflection wheels 5, are arranged around the periphery of each deflection wheel 5. The conveyor member 1 with the carrier elements 2 is deflected by the deflection wheels 5 in different planes (three planes perpendicular to one another in the represented case), and is forcibly twisted at twist locations 7 between deflections in different planes.

If the friction between the guide members 6.1 and 6.2 and carrier elements 2 is adequately large, then one of the deflection wheels 5 may also be designed as a conveyor drive, which means it is not mounted in a freely rotating manner, but suitably driven in a rotating manner. A chain wheel with teeth (not shown) may also be applied, for example as a conveyor drive, wherein the teeth engage into the belt-like conveyor member 1, between the cables 1.1 and 1.2 and between adjacent carrier elements 2.

The conveyor system according to FIG. 1 is designed for conveying an imbricate flow 10 in the conveyor direction F, wherein printed products 11 are arranged overlapping one another in the imbricate flow 10. The imbricate flow 10 is gripped by the grippers 3 of the carrier elements 2 in a gripping location 12 and are released in a releasing location 13, wherein the distances of the grippers 3 on the belt-like conveyor member 1 and the length of the products 11 and their overlapping in the imbricate flow 10 are for example matched to one another such that each gripper 3 grips a plurality of products 11 overlapping one another, and each product 11 is held by a plurality of grippers 3. In this manner, the imbricate flow 10 is held and conveyed as a whole. Control means 15 are arranged at the gripping location 12 and at the releasing location 13, with which the grippers for gripping are opened as the case may be, and closed again; and for the release are opened and are closed again, if required.

FIG. 2 in a larger scale, shows a section (section line II-II in FIG. 1) through one of the deflection wheels 5 represented in FIG. 1, as well as a carrier element 2 which is fastened on at least one of the cables 1.1 and 1.2, and is conveyed about the deflection wheel 5. The carrier element 2 is equipped with an exemplary gripper 3, wherein the gripper 3 is closed about one edge of a printed product 11. The deflection wheel 5 is rotatingly mounted freely about an axis A, or, if its serves as a conveyor drive, is also rotatingly driven about this axis A.

The represented carrier element 2 comprises two clamping parts 2.1 and 2.2, which at their oppositely directed sides comprise inner grooves 20.1 and 20.2 which are aligned to one another, are matched in their cross section to the cables 1.1 and 1.2, and together in each case form an opening for the cables 1.1 and 1.2, which leads through the carrier element 2. The clamping parts 2.1, 2.2 are clamped against one another with suitable, non-shown clamping means, in a manner such that the carrier element 2 is fastened in a positionally fixed manner on at least one of the cables 1.1, 1.2 by way of the clamping effect. Furthermore, the clamping parts 2.1 and 2.2 comprise outer grooves 21.1 and 21.2 which run parallel to the inner grooves 20.1 and 20.2, and are adapted to the revolving guide members 6.1 and 6.2 of the guide means 4. The revolving guide members 6.1 and 6.2 in the present case are designed as chords which are arranged in corresponding grooves 22.1 and 22.2 running around the periphery of the deflection wheel 5.

In order for the carrier elements 2 to be able to be deflected in different directions by way of equal guide means, both clamping parts 2.1 and 2.2 comprise outer grooves 21.1 and 21.2, as this is shown in FIG. 2. In order for the carrier elements 2 to be able to be applied in an as comprehensive as possible manner, these preferably comprise a third inner groove 20.3, which is arranged centrally between the two outer grooves 21.1 and 21.2, and in the embodiments of the conveyor system according to the invention, are used with only one cable (see FIGS. 6 to 8) for receiving the cable. Whilst it would be evidently possible in the represented case of a conveyor system with two cables, to provide a guide wheel 5 with only one revolving guide member and to arrange this for a contact with the carrier elements between the two cables, in the case of the conveyor system with only one cable, it is necessary for two revolving guide members to be provided. Of course, it is also possible to provide further cables and/or further revolving guide members and corresponding grooves in the clamping parts 2.1 and 2.2.

FIG. 3, again in an enlarged scale, shows a twist location 7 of the conveyor system according to FIG. 1, which for example occurs between a deflection wheel 5 with a vertical axis (deflection plane horizontal) and a deflection wheel 5 following this, with a horizontal axis (deflection plane vertical). The same elements are indicated with the same reference numerals as in FIG. 1. The carrier elements 2 are the same as those in FIG. 2. The clamping means, with which the two clamping parts 2.1 and 2.2 of the carrier elements 2 are clamped about the cables 1.1 and 1.2, are screws 25 which are engage from one clamping part into the other clamping part, and which are arranged in the region of the cable 1.1. By way of this, a larger clamping force around the cable 1.1 than around the cable 1.2 results (with equally designed inner grooves), in a manner such that the holding elements 2 are fastened on the cable 1.1 in a positionally fixed manner and render this a pull cable, whilst they likewise encompass the cable 1.2, but are somewhat movable relative thereto, and this cable becomes a guide cable due to this.

Figure 3:
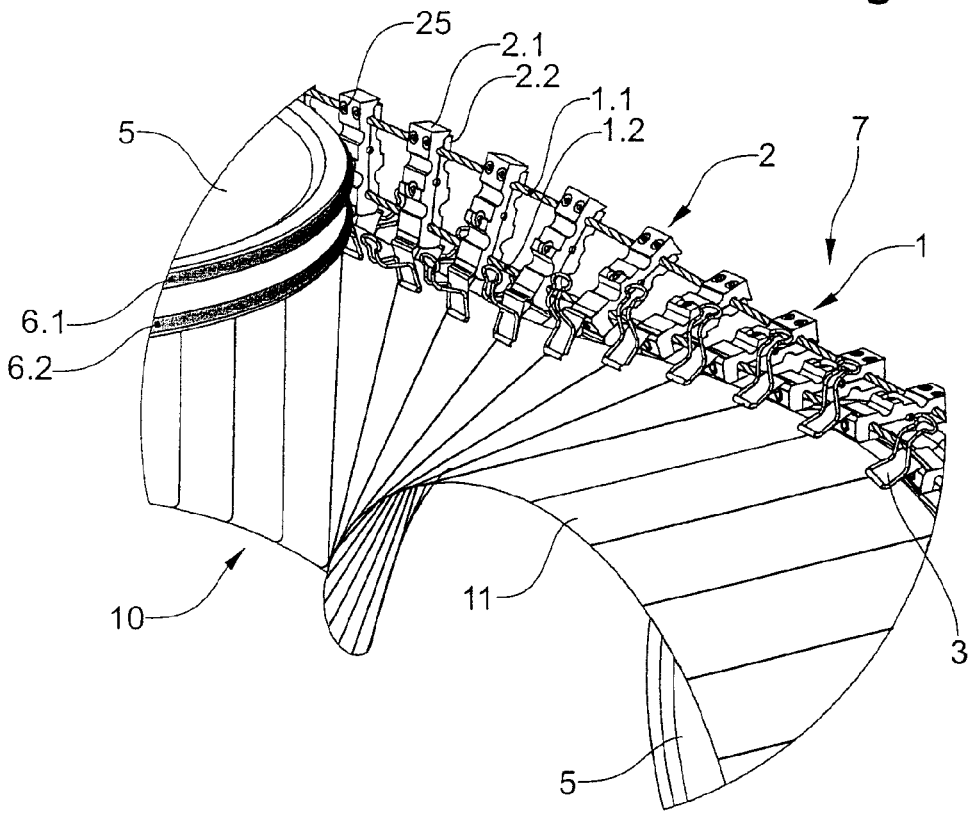
FIG. 3 is a perspective view of a twist location of the conveyor system according to FIG. 1, in a larger scale.

It is evident from FIG. 3 that in the twist location 7, not only is the relative spatial position of the two cables 1.1 and 1.2 changed, but also the spatial position of the carrier elements 2 and thus also the spatial position of the printed products 11 held by the grippers 3.

Figure 4:
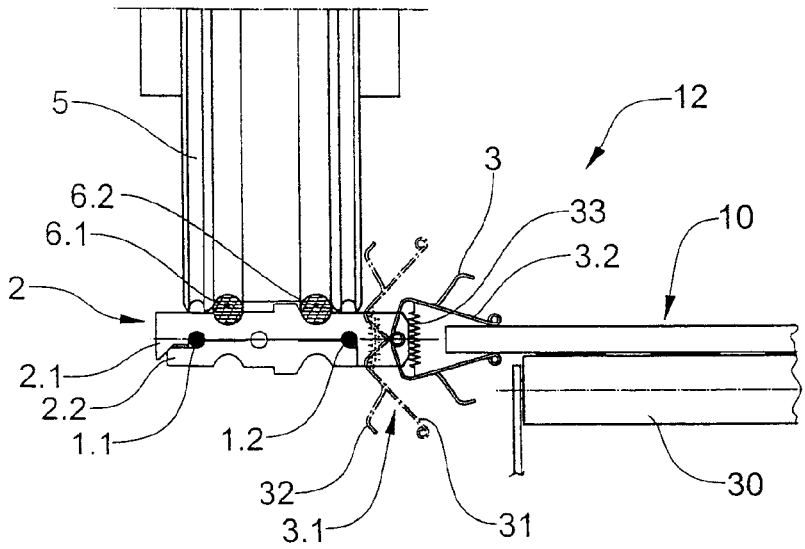
FIG. 4 is a cross-sectional elevation view of an exemplary gripping location or release location of the conveyor system according to FIG. 1 (section parallel to the axis of the deflection wheel, section line IV-IV in FIG. 1)

FIG. 4 shows a section (section line IV-IV in FIG. 1) through the deflection wheel 5 of the gripping location 12 (FIG. 1), as is represented in FIG. 1. The same elements are again indicated with the same reference numerals. The gripping location 12 lies in the region of the lower apex point of the deflection wheel 5. The grippers 3 (designed somewhat differently than the gripper represented in FIG. 2), in the opened condition (3.1, dot-dashed), run into the gripping location 12, and are closed at the gripping location, in order to grip a lateral edge of the imbricate flow 10, which for example is conveyed on a conveyor belt 30 into the gripping location 12. The gripper 3 in the closed condition is indicated at 3.2 and is represented unbroken. Control means (e.g. a stationary cam) which are not shown, for opening the grippers 3, for example engages on cam wings 32 connected to the gripper jaws 31, and drive the gripper jaws 31 against the clamping force of a spring 33 into a position distanced to one another (gripper open). The spring 33 closes the gripper 3 which thus grips the edge region of the imbricate flow 10, when the action of the control means is ceased.

Figure 5:
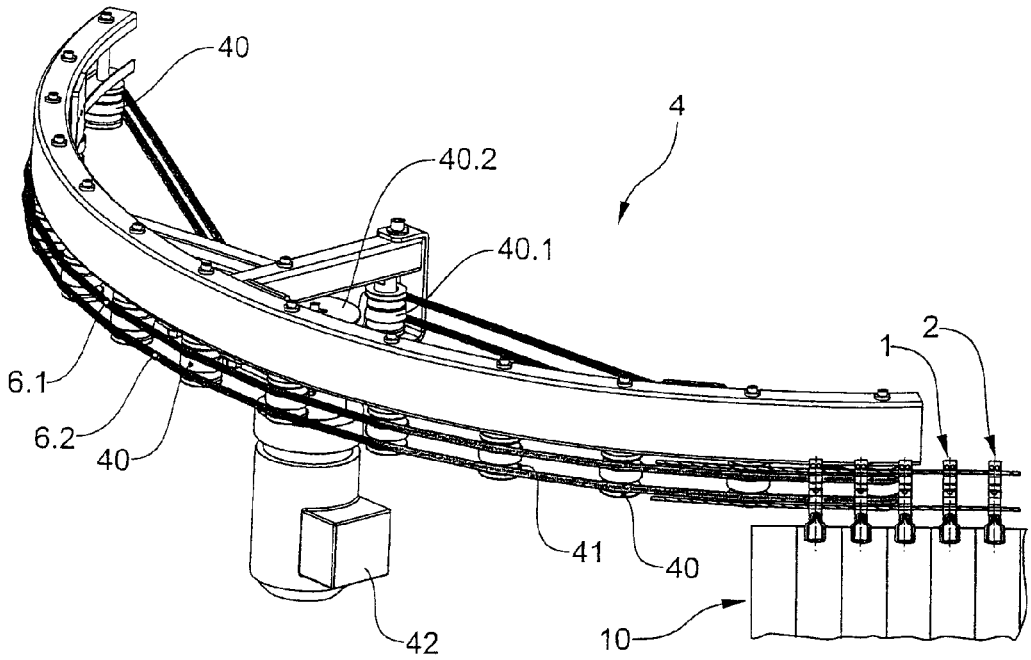
FIG. 5 is a perspective view of a further guide means which may be used in a conveyor system according to FIG. 1.

FIG. 5 shows a further exemplary guide means 4 or deflection means, which may be applied in a conveyor system according to FIG. 1. In contrast to the deflection wheels 5 of FIG. 1, the two revolving guide members 6.1 and 6.2 of the guide means 4 according to FIG. 5 are not arranged around the periphery of the wheel, but they run over a plurality of rollers 40 mounted in a freely rotating manner, wherein the rollers 40 are arranged in a curve and on their periphery comprise runner channels 41 adapted the revolving guide members 6.1, 6.2. Preferably, the guide means 4 also comprises a resiliently mounted roller 40.1 serving as a tension roller. If the guide means 4 according to FIG. 5 is also to function as a conveyor drive, then it additionally comprises a roller 40.2 designed as a drive roller, which is rotatingly driven by its own drive 42. In order for the slip between the drive roller 40.2 and the guide members 6.1 and 6.2 to be kept as small as possible, it is advantageous to arrange the rollers 40 and 40.1 in a manner such that the wrapping of the drive roller 40.2 by the guide members 6.1 and 6.2 is as large as possible.

Figure 6:
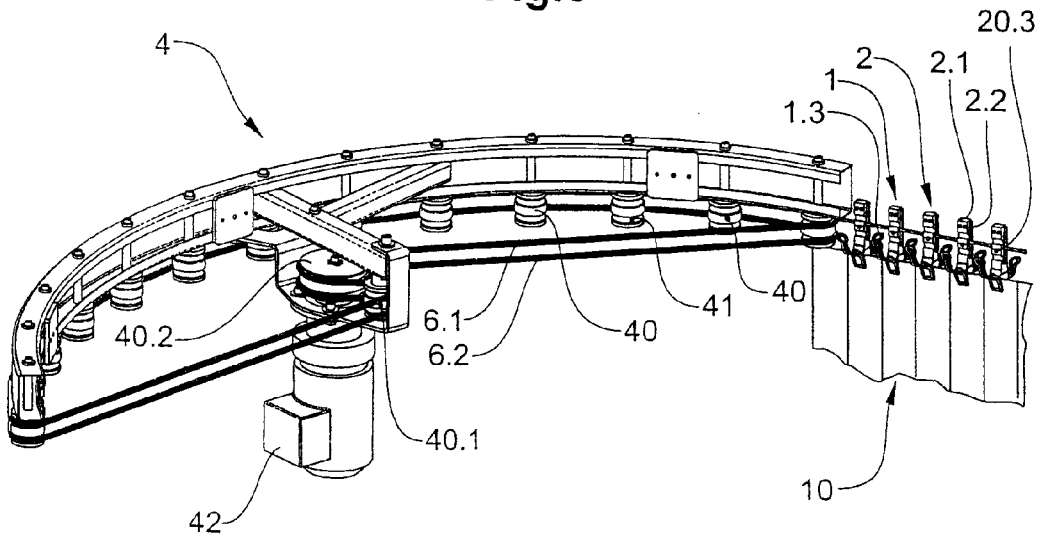
FIG. 6 is a perspective view of a guide means as in FIG. 5, applied in a conveyor system with only one pull cable.

FIG. 6 shows an equal guide means 4 as in FIG. 5, which however is applied in a conveyor system with only one pull cable 1.3. The carrier elements 2 are the same as those described in connection with FIG. 2, wherein the single cable 1.3 runs through the middle inner grooves 20.3 of the clamping parts 2.1 and 2.2 of the carrier elements 2.

Figure 7:
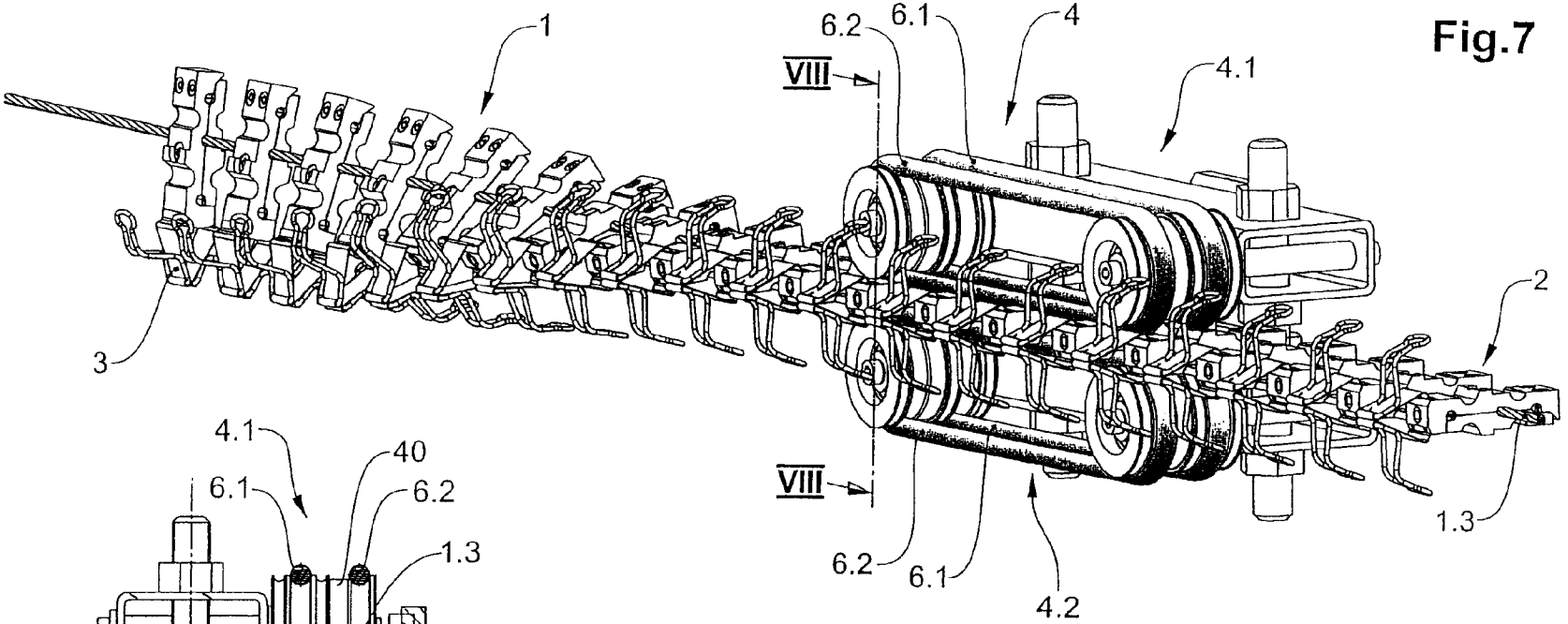
FIG. 7 is a perspective view of a further guide means, applied in a conveyor system with only one pull cable, wherein the conveyor member is twisted and supported by the guide means, but not deflected.
Figure 8:
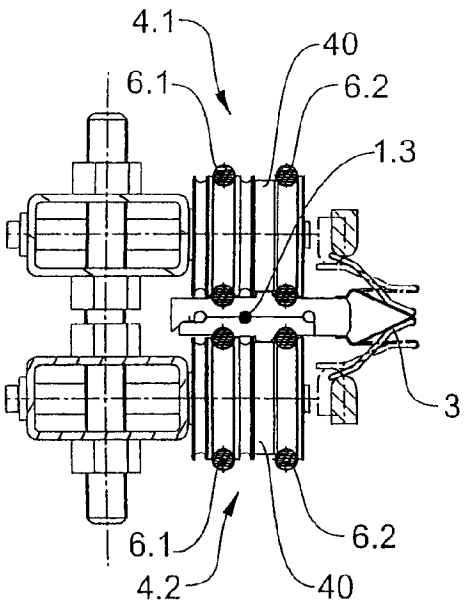
FIG. 8 is a cross-sectional elevation view of section line VIII-VIII in FIG. 7, sectioned transversely to the conveyor direction.

FIGS. 7 and 8 show further, exemplary guide means 4, which do not effect a deflection of the conveyor member 1, but only a twisting of the conveyor member 1. These guide means 4 consist of two guide means parts 4.1 and 4.2 which engage on opposite sides of the carrier element 2 and which are designed in essentially the same manner as the guide means described in combination with the FIGS. 5 and 6. FIG. 7 shows the guide means in a three-dimensional representation, FIG. 8 in a section perpendicular to the conveyor direction (section line VIII-VIII in FIG. 7).

The two guide means parts 4.1 and 4.2 again, in each case comprise the two revolving guide members 6.1 and 6.2, which in the present case each run over two rollers 40. The axes of the rollers 40 are all arranged at the same distance to the carrier elements 2 parallel to one another and perpendicularly to the conveyor direction, so that the conveyor member 1 which is guided between the guide members running over the rollers 40, is not deflected but only twisted. The carrier elements 2 are the same as the carrier elements described in the context of FIG. 2. One may particularly deduce from FIG. 8, that it makes essentially no difference as to whether the conveyor member comprises one cable or two cables.

The conveyor member 1 for example runs with vertically aligned carrier elements 2 against the guide means 4 (for example from a deflection in a horizontal plane), and is twisted by the guide means 4, in a manner such that the carrier elements 2 are rotated into a horizontal position. Evidently, it is also possible to arrange the guide means parts 4.1 and 4.2 in a manner such that the guide member is not twisted, but is held and stabilized in a position which it has already before running into the guide means 4. In this manner, this position is held in a precise manner, which may be particularly important for conveyor members with only one cable, since these may be twisted already by way of very small side forces, and thus may advantageously be guided at locations, at which an exact positioning of the grippers 3 is necessary.

It is evident from FIGS. 1 to 8, that with the use of one of the shown guide means 4 as a conveyor drive, the conveyor system may be operated in two opposite directions, and the operation is essentially independent of the distance of the carrier elements 2 in the conveyor member 1. This distance may thus be adapted to the respective use, and to characteristics of the printed products to be conveyed, without other system parts having to be used on account of this. If, for a specific application, such a large distance between the carrier elements 2 should be necessary, that the cable or the cables are kinked too much with deflections before and after a carrier element, or that the cable or the cables come into undesired contact with parts of guide means 4, between the carrier elements in deflections, so-called blind carrier elements without grippers also may be integrated in the conveyor member between the conveying carrier elements, thus those equipped with grippers.

In particular, wire cables with a diameter of approx. 5 mm or less are applied as cables 1.1, 1.2 or 1.3. It has been shown that carrier elements for the usual loads in the mentioned field of technology may not only be fastened in a positionally fixed manner, but also in a rotational fixed manner on such cables without further clamping. The advantage of the embodiments with more than one cable lies in the fact that the belt-like conveyor member has a greater twisting stiffness. The advantage of the embodiment forms with only one cable lies in the fact that apart from the guide means 4 described above, for deflecting the conveyor member, one may also apply other, for example cog-like deflection means, by way of which deflections with carrier members directed parallel to the deflection plane, and grippers which are spread apart on account of this, are possible, which entails an even greater flexibility.

Figure 9:
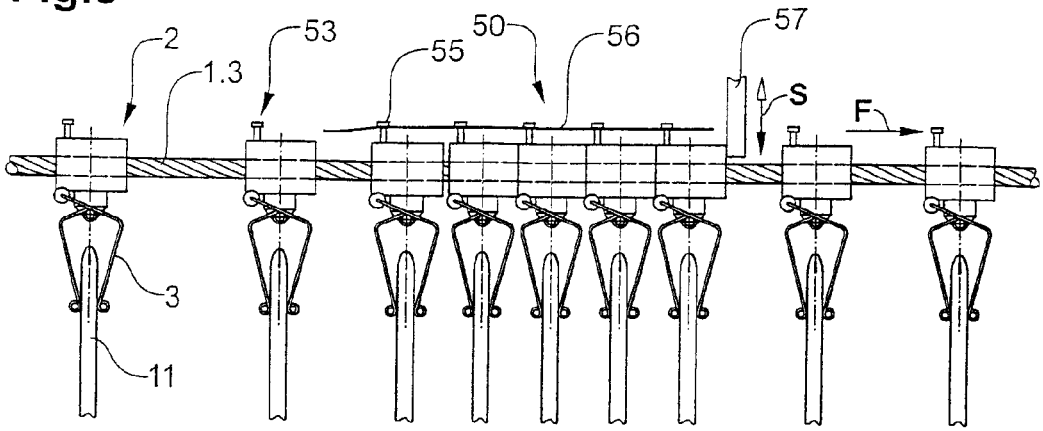
FIG. 9 is an elevation view of a buffer stretch of the carrier elements.
Figure 10:
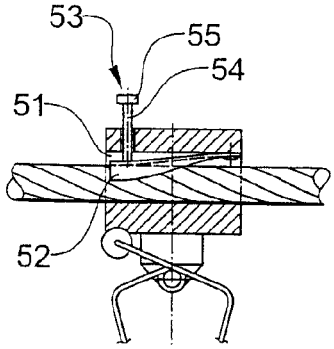
FIG. 10 is an elevation view of the carrier element in section parallel to the pull cable in the condition fastened on the cable, and in the condition released from this.
Figure 11:
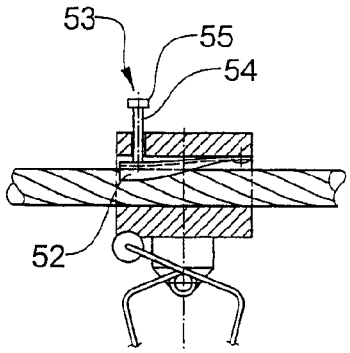
FIG. 11 is an elevation view of the carrier element in section parallel to the pull cable in the condition fastened on the cable, and in the condition released from this.
Figure 12:
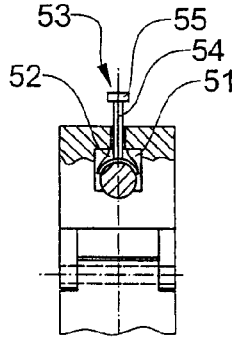
FIG. 12 is an elevation view of the carrier element in a section transversely to the pull cable.
Figure 13:
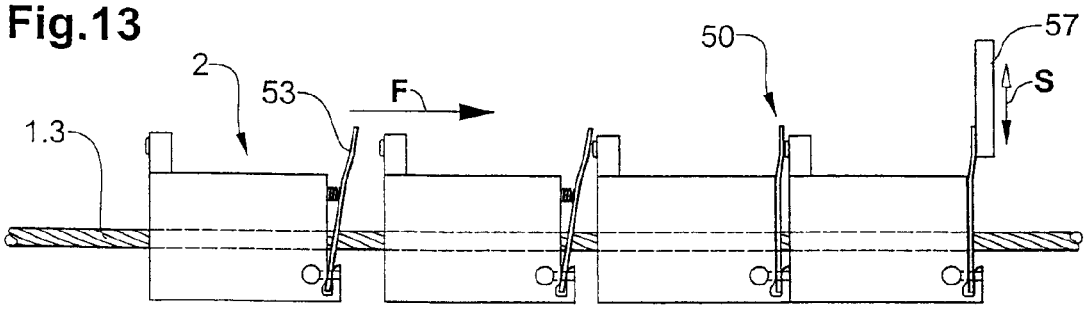
FIG. 13 is an elevation view of a buffer stretch of the carrier elements.

FIGS. 9 to 14 shows further embodiments of carrier elements 2 which may be applied in the conveyor system according to the invention. These carrier elements 2 are releasably fastened on a pull cable 1.3, in a manner such that the pull cable 1.3 may no longer pull but still guide the carrier elements 2 given a released fastening, so that the carrier elements 2 are slidable along the cable 1.3, or the carrier elements 2 may stand still, whilst the cable 1.3 revolves. The distances of the carrier elements 2 from one another may also be set during the conveyor operation by way of temporarily releasing the fastening. FIGS. 9 and 13 show an exemplary application of such carrier elements 2 releasably fastened on the pull cable 1.3, specifically a buffer stretch 50 on which carrier elements 2 are dammed and are released again in a controlled manner, for example in a regularly cycled manner.

The carrier elements 2 of FIGS. 9 to 12 comprise a continuous opening 51 for the cable 1.3, and which for example is formed by inner grooves aligned to one another, in two clamping parts, similarly to the carrier elements discussed in combination with FIG. 2. Thereby, the grooves however are dimensioned in a manner such that the opening 51 has an inner cross section which is larger than the cable cross section, thus the cable may run through the opening in a loose manner. Additionally, a clamping device, for example a clamping spring 52, is arranged in the opening 51, and is sufficiently biased against the cable, in order to be able to firmly hold the cable in the opening 51 is a positionally fixed and, as the case maybe, rotationally secured manner. A control element 53 actively connected to the clamping device projects from the opening 51 out of the carrier element 2, via which control element 53, the clamping effect of the clamping spring 52 may be lifted or reactivated in a controlled manner. The control element 53, as represented in the FIGS. 9 to 12, is for example a control lever 54 with a control slide 55 or control roller which slide or roll on a suitable cam 56, in a manner such that the clamping spring 52 is lifted by the control lever 54 from the cable 3.1 by its own spring force, when the connection between the cable 1.3 and the carrier element 2 is to be released. Simultaneously, the control element 53 and the cam 56 may be used in order to maintain the rotation position of the carrier elements 2 on the cable 1.3, or to change it in a controlled manner, whilst the clamping spring 52 is held in its inactive position.

The buffer stretch 50 represented in FIG. 9 comprises a stop 57, which for example in a regularly cycled manner, projects into the conveyor path of the carrier elements 2 or is removed from this (double arrow S). The cam 56 is arranged behind the stop 57 in the conveyor direction F, by way of which cam the connection between the carrier elements 2 which are conveyed against the stop 57, and the cable 1.3, is kept released. The carrier elements 2 are then conveyed by an individual drive, which may be gravity with a dropping conveyor path, against the stop 57 and the carrier elements dammed by this. If the stop 57 releases a carrier element 2, then this leaves the region of the cam 56 and by way of this, is again fastened on the cable 1.3 and conveyed further, whilst the loose carrier elements 2 follow on against the stop 57.

For illustration of the clamping device by way of clamping springs 52 described above, FIGS. 10 and 11 show a carrier element 2 according to FIG. 9 sectioned parallel to the cable 1.3, fastened on the cable and in the condition released from the cable, and FIG. 12 shows the same carrier element 2 sectioned transversely to the cable 1.3.

Figure 14:
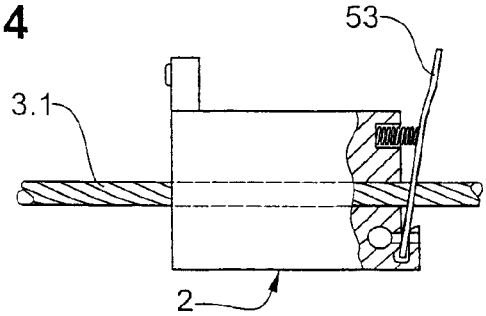
FIG. 14 is an elevation view of the carrier element sectioned partly parallel to the pull cable.

FIGS. 13 and 14 show a further carrier element 2 which is released from the pull cable 1.3 and is led through the pull cable in the released condition. The connection between the carrier element 2 and the cable 1.3 is again controllable via a control element 53 in a manner not represented in more detail, wherein the control element 53 is activated by a carrier element 2 which runs in front and which is already released from the cable, and is thus moved more slowly or stands still. One may realize buffer stretches 50 of an infinite length with carrier elements 2 equipped in such a manner, whilst the buffer stretch according to FIG. 9 may not be longer than the length over which the connections between the carrier element 2 and cable 1.3 may be held in a released manner by the cam 56.

In this context, it is possible for the man skilled in the art, without further ado, in this context, to adapt the carrier elements 2 and their releasable fastening on the cable 1.3, as they are represented in the FIGS. 9 to 14, to applications with more than one cable and for other applications, which are thus not buffer stretches.

Figure 15:
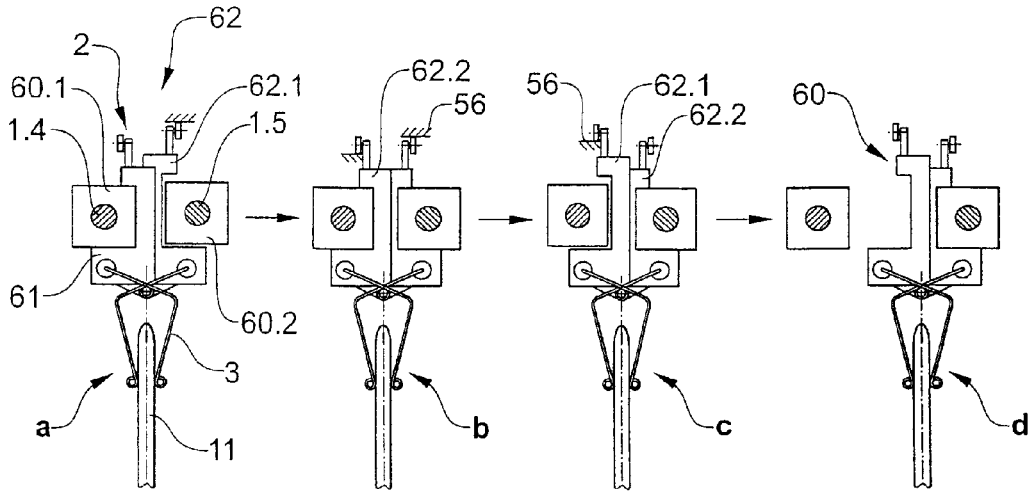
FIG. 15 is an elevation view of a further exemplary embodiment of carrier elements which may be applied in the conveyor system according to the invention, with releasable connection to the pull cable, in a manner such that the carrier elements may be decoupled from the pull cable and may be fastened on another pull cable (four consecutive stages of a transfer from one pull cable to the other pull cable)
Figure 16:
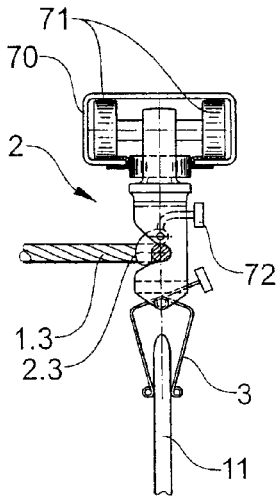
FIG. 16 is an elevation view of the carrier element in the condition coupled on the pull cable.
Figure 17:
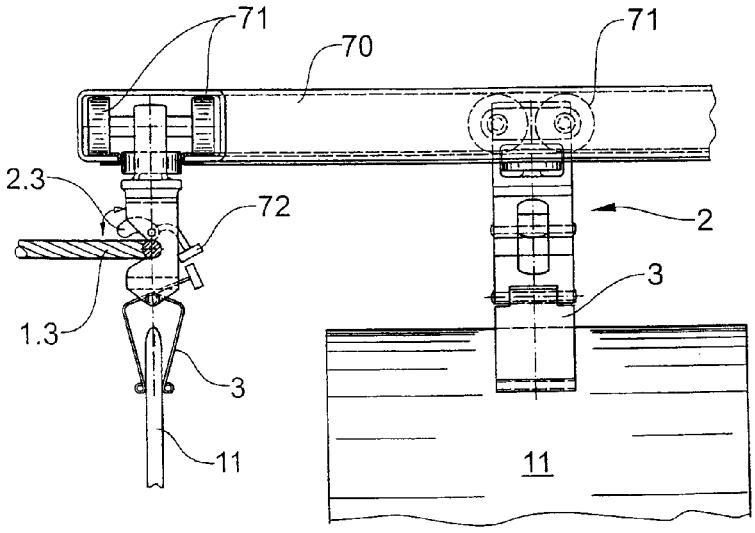
FIG. 17 is an elevation view of the carrier element in the condition decoupled from the pull cable and guided in a guide channel).

FIGS. 15 to 17 show carrier elements 2, whose fastening on the pull cable is not only releasable, but which may be completely decoupled from the cable. The same figures also show exemplary applications for such carrier elements.

The carrier elements 2 according to FIG. 15 may be transferred from a first cable 1.4 to a second cable 1.5, wherein, fastened on the first cable 1.4, they are conveyed into a transfer location (condition a), and in the transfer location in which the two cables 1.4 and 1.5 are led parallel next to one another, are fasted on the second cable 1.5 (condition b), and then decoupled from the first cable 1.4 (condition c). After the transfer location, the carrier element 2 is led away fastened on the second cable 1.5 (condition d). In order to permit the mentioned transfer, the carrier element function is for example distributed to three separate elements which are essentially independent of one another, specifically to two fastening parts 60.1 and 60.2 which are assigned in each case to one of the cables 1.4 and 1.5 and are rigidly or releasably fastened on this, and to carrier part 61, which carries the gripper 3 and which may be selectively coupled to the one or the other fastening part 60.1 or 60.2, for example, as represented in FIG. 15, by way of suitable clamping means 62 (62.1 clamping means in deactivated condition, 62.2 clamping means in the activated condition) which may be activated and accordingly activated again via a control means (e.g. cam 56).

Of course, it is also possible to design the clamping means for a direct fastening to the first and the second cable 1.4 and 1.5, instead of providing separate fastening parts for this for the fastening on the cables 1.4 and 1.5, as is the case in FIG. 15.

FIGS. 16 and 17 show a further embodiment of carrier elements 2 which may be decoupled from the pull cable 1.3 and which are provided with runner rollers 71 on its side lying opposite the gripper 3, for guiding in a guide channel 70. A pivotable clamping lever 2.3 is provided for fastening on the pull cable 1.3, and this lever with a cam roller 72 which runs on a cam which is not shown and by way of which the pivotable clamping lever is applied around the cable (carrier element fastened on the cable, FIG. 16) or is distanced to this (carrier element released from the cable and may be decoupled or is decoupled, FIG. 17).

FIG. 16 shows the leading of the carrier element 2 against a deflection, in which the cable 1.3 is deflected to the left. Before the deflection of the cable, the guide channel 70 runs parallel to the cable 1.3, and the runner rollers 71 run in the channel 70. This condition is shown in FIG. 16. Between the run-in of the runner rollers 71 into the channel 70, and the cable deflection, thus with a still parallel guiding of the cable 1.3 and the guide channel 70, the fastening of the carrier element 2 on the cable 1.3 is released (clamping lever 2, 3 pivoted up, on the left in FIG. 17) and the carrier element 2, as soon as it comes onto a region in which the cable 1.3 and the guide channel 70 no longer run parallel (on the right in FIG. 17), is decoupled from the cable 1.3.

A coupling onto the cable runs essentially in a reverse manner to the decoupling described above.

The above description and the figures clearly show that very many different conveyor tasks may be solved with the conveyor system according to the invention. Thereby, the cables, the carrier elements and the guide means may be joined together in a modular manner into the most different of conveyor systems, and/or one may realize conveyer paths with the carrier elements which are releasable or may even be decoupled from the pull cable, on which the most different of conveyor tasks are solved one after the other.

The invention claimed is:

1. A conveyor system for conveying printed products, said conveyor system comprising:

a revolving conveyor member, grippers arranged on the revolving conveyor member, wherein the grippers are designed for gripping, holding and releasing individual printed products or groups of printed products, guide means leading and/or deflecting the conveyor member, wherein the conveyor member comprises a revolving first pull cable as well as a plurality of carrier elements that are adapted to be fastened on the first pull cable in a positionally fixed manner, and optionally in a rotationally secured manner, such that the carrier elements project from the first pull cable aligned to one another, and the grippers, which are arranged on the carrier elements, form a row essentially parallel to the first pull cable, wherein the guide means comprise revolving guide members that are arranged for contact with the carrier elements, and wherein at least one further cable is provided additionally to the first pull cable, said further cable arranged revolving essentially parallel the first pull cable, and wherein the carrier elements are fastened or guided on the further cable such that the at least two cables together with the carrier elements form a belt-like conveyor member with grippers arranged laterally thereon.

2. The conveyor system according to claim 1, wherein the revolving guide members are revolvingly drivable by at least one guide means for the drive of the conveyor member.

3. The conveyor system according to claim 1, wherein the conveyor member is twisted by guide means, which deflect the conveyor member in different planes, and/or by guide means, which act on the conveyor member in straight-lined regions of the revolving path.

4. The conveyor system according to claim 1, wherein each carrier element comprises two clamping parts and clamping means, for fastening on the first pull cable.

5. The conveyor system according to claim 4, wherein the clamping parts comprise inner grooves adapted to the first pull cable.

6. The conveyor system according to claim 5, wherein each clamping part comprises three inner grooves.

7. The conveyor system according to claim 5, wherein the carrier elements comprise outer grooves that are adapted to the revolving guide members and that have positions which are offset relative to the inner grooves.

8. The conveyor system according to claim 7, wherein the carrier elements on both sides in each case have two outer grooves.

9. The conveyor system according to claim 1, wherein the revolving guide members are spanned on the periphery of the deflection wheels or run over rollers.

10. The conveyor system according to claim 1, wherein the guide means in each case comprise at least two guide members revolving parallel to one another.

11. The conveyor system according to claim 1, wherein each carrier element comprises two clamping parts and clamping means, for fastening on the first pull cable and the clamping parts comprise inner grooves adapted to the at least one further cable.

12. The conveyor system according to claim 1, wherein said further cable is as equally long as the first pull cable.

13. A conveyor system for conveying printed products, said conveyor system comprising:

a revolving conveyor member, grippers arranged on the revolving conveyor member, wherein the grippers are designed for gripping, holding and releasing individual printed products or groups of printed products, means leading and/or deflecting the conveyor member, wherein the conveyor member comprises a revolving pull cable as well as a plurality of carrier elements that are adapted to be fastened on the pull cable in a positionally fixed manner, and optionally in a rotationally secured manner, such that the carrier elements project from the pull cable aligned to one another, and the grippers, which are arranged on the carrier elements, form a row essentially parallel to the pull cable, wherein the guide means comprise revolving guide members that are arranged for contact with the carrier elements, and wherein the carrier elements are releasably fastened on the pull cable and the system comprises control means for releasing and refastening of carrier elements on the pull-cable.

14. The conveyor system according to claim 13, wherein the control means comprise a clamping spring with which the pull cable may be pressed against the carrier element, as well as a control element which is fastened on the clamping spring and projects out of the carrier element and, by way of whose actuation, the clamping spring is movable against its spring force, and thus fastening between the carrier element and the pull cable may be released.

15. The conveyor system according to claim 14, wherein the control element is arranged for an actuation with the help of a stationary cam.

16. The conveyor system according to claim 14, wherein the control element is arranged for an actuation of a dammed carrier element running in front.

17. The conveyor system according to claim 13, wherein a region of the revolving path of the conveyor member is designed as a buffer stretch, wherein a stop is arranged on a front end of the buffer stretch as seen in the conveying direction.

18. The conveyor system according to claim 13, wherein the carrier elements may be decoupled from the pull cable.

19. The conveyor system according to claim 18, wherein the carrier elements are equipped with means for coupling to two cables running parallel next to one another, and wherein the revolving path has a region in which it is arranged parallel to and side by side with a further revolving path.

20. The conveyor system according to claim 18, wherein the carrier elements are provided with rollers for a guiding in a guide channel, and wherein a region of the revolving path is arranged parallel to the guide channel, and these are arranged side by side.

21. The conveyor system according to claim 13, wherein at least one further cable is provided additionally to the pull cable, said further cable being as equally long as the pull cable and arranged revolving essentially parallel thereto, wherein the carrier elements are fastened or guided on the further cable such that the at least two cables together with the carrier elements form a belt-conveyor member with grippers arranged laterally thereon.

22. The conveyor system according to claim 13, wherein the conveyor member is twisted by guide means, which deflect the conveyor member in different planes, and/or by guide means, which act on the conveyor member in straight-lined regions of the revolving path.

23. The conveyor system according to claim 21, wherein the carrier elements may be decoupled from the at least one further cable.

* * * * *